US009131584B2

(12) United States Patent
Yu

(10) Patent No.: US 9,131,584 B2
(45) Date of Patent: Sep. 8, 2015

(54) AIRFIELD LIGHTING SUSTEM

(71) Applicant: LSIS CO., LTD., Anyang-si, Gyeonggi-do (KR)

(72) Inventor: Young Gyu Yu, Seoul (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 281 days.

(21) Appl. No.: 13/944,688

(22) Filed: Jul. 17, 2013

(65) Prior Publication Data

US 2014/0042923 A1 Feb. 13, 2014

(30) Foreign Application Priority Data

Aug. 7, 2012 (KR) ..... 10-2012-0086222

(51) Int. Cl.
*H05B 37/00* (2006.01)
*H05B 33/08* (2006.01)
*H05B 37/03* (2006.01)

(52) U.S. Cl.
CPC ..... *H05B 33/089* (2013.01); *H05B 33/0893* (2013.01); *H05B 37/038* (2013.01)

(58) Field of Classification Search
None
See application file for complete search history.

(56) References Cited

U.S. PATENT DOCUMENTS

| | | | | |
|---|---|---|---|---|
| 2005/0030192 | A1* | 2/2005 | Weaver et al. | 340/815.45 |
| 2007/0013557 | A1* | 1/2007 | Wang et al. | 340/945 |
| 2008/0272937 | A1* | 11/2008 | That et al. | 340/947 |
| 2009/0091268 | A1* | 4/2009 | Forssen et al. | 315/250 |
| 2011/0199195 | A1* | 8/2011 | Yu | 340/12.32 |
| 2012/0189298 | A1* | 7/2012 | Ohad et al. | 398/9 |

* cited by examiner

*Primary Examiner* — Cassandra Cox
(74) *Attorney, Agent, or Firm* — Lee, Hong, Degerman, Kang & Waimey

(57) ABSTRACT

An airfield lighting system is provided, the system including a constant current regulator configured to output a constant current, a plurality of insulating transformers configured to be electrically connected to the constant current regulator to supply an electric power, and a plurality of individual lighting devices each electrically connected to the insulating transformer to turn on or turn off an LED lamp, wherein the individual lighting apparatus includes an LED unit including an ADC (AC-DC Converter) and at least one LED lamp connected to a secondary side of the ADC and transmitting defect information of the LED lamp, and a defect information receiver configured to measure a current and a voltage at a primary side of the ADC, measure an electric energy (electricity) or a resistance value using the measured current and voltage, and generate status information of the LED unit.

9 Claims, 5 Drawing Sheets

AIRFIELD LIGHTING SUSTEM

CROSS-REFERENCE TO RELATED APPLICATION

Pursuant to 35 U.S.C. §119 (a), this application claims the benefit of earlier filing date and right of priority to Korean Patent Application No. 10-2012-0086222, filed on Aug. 7, 2012, the contents of which are hereby incorporated by reference in their entirety.

BACKGROUND OF THE INVENTION

1. Field of the Invention

Exemplary embodiments of the present disclosure relate to an airfield lighting system, and more particularly to an airfield lighting system configured to efficiently detect a defect of an LED lamp.

2. Description of Related Art

Generally, airfield lighting systems are aviation safety facilities used for directing airplanes during landing, take-off and taxiing. These lighting systems have a large number of light sources and it is important they are operated properly and that failed light sources are replaced quickly, especially during times of low visibility. Otherwise, the consequences of a plane missing a taxiway or a stop signal can be disastrous.

Although an aircraft pilot performs most of aircraft manipulations and collects information relying on visual and audio senses, most of the information is collected by eyes such that airfield lighting is very important in terms of its function.

Although conventional airfield lighting systems largely use halogen lamps, the halogen lamps are disadvantageous in that the lamps are low in efficiency and generate a large quantity of heat, albeit being advantageous in terms of miniaturization and color rendering.

Concomitant with global requirement on high energy efficiency in response to demand on highly efficient devices, lighting industries pay attention to LEDs (Light Emitting Devices), one of next generation light sources excellent in energy saving effect over conventional light sources and capable of being permanently used.

LEDs offer many advantages over conventional halogen lamps or incandescent lights, which are driving the adoption of same. These advantages include but are not limited to high energy efficiency, long lifetime, low maintenance cost, enhanced reliability and durability, as well as no lumen loss induced by filtering. As a result, the LEDs are widely used recently by replacing various lighting sources including halogen lamps, incandescent electric bulbs and fluorescent lamps. In response to this trend, aviation industries also participated in demands on savings in energy and maintenance/repair costs by replacing halogen lamps with LED lamps.

Meanwhile, ILCMS (Individual Lamp Control and Monitoring System) is a system configured to control ON/OFF of airfield lighting system on runways and taxiways, and to monitor airfield lighting state. The airfield lighting system uses a constant current source having a single loop. At this time, several scores to several hundreds of lamps are disposed from a CCR (Constant Current Regulator) to a final end of an airfield, and length of electric lines connecting the lamps ranges from several kilometers to several hundred kilometers. The airfield lighting electric source formed with a single loop supplies an electric power to electronic circuits for operation of a secondary lamp and ILCMS through a transformer having a current transformer characteristic.

At airports, communications are wirelessly performed between aircraft pilots and a control tower, such that wired communication is preferred to avoid interference by other wireless communication. It is difficult to newly install lines at existing airports, and therefore, application of power cable communication is essential for individual lamp control and monitoring system for airfield lighting system.

Under this circumstance, in a case LED lamps are used for the airfield lighting system, there is a problem in that defects of lighting lamps used for the existing airfield lighting facilities cannot be detected. Thus, technical development for efficiently detecting defects of LED lamps is necessary even if the LED lamps are used for airfield lighting system.

SUMMARY OF THE INVENTION

Exemplary aspects of the present disclosure are to substantially solve at least the above problems and/or disadvantages and to provide at least the advantages as mentioned below. Thus, the present disclosure is directed to provide an airfield lighting system configured to efficiently recognize or detect, by an individual lighting unit and a high-level monitoring panel, defects of LED lamps, in a case the LED lamps are applied to the airfield lighting system.

In one general aspect of the present disclosure, there is provided an airfield lighting system including a constant current regulator configured to output a constant current, a plurality of insulating transformers configured to be electrically connected to the constant current regulator to supply an electric power, and a plurality of individual lighting devices each electrically connected to the insulating transformer to turn on or turn off an LED lamp, wherein the individual lighting apparatus includes an LED unit including an ADC (AC-DC Converter) and at least one LED lamp connected to a secondary side of the ADC and transmitting defect information of the LED lamp, and a defect information receiver configured to measure a current and a voltage at a primary side of the ADC, measure an electric energy (electricity) or a resistance value using the measured current and voltage, and generate status information of the LED unit.

Preferably, but not necessarily, the LED unit may include a defect detecting unit configured to output a defect detection signal, in a case defect of the LED lamp is detected, and a defect information transmitter configured to transmit the defect information of the LED lamp by opening or closing a path at the secondary side of the ADC to the defect information receiver, in a case the defect detection signal is received from the defect detection unit.

Preferably, but not necessarily, the defect information transmitter may include a defect transmission controller configured to output a switching control signal, in a case the defect detection signal is received from the defect detection unit, and a transmission switch configured to be opened or closed in response to the switching control signal outputted from the defect transmission controller.

Preferably, but not necessarily, the transmission switch may be connected in series to the secondary side of the ADC to be opened in response to the switching control signal.

Preferably, but not necessarily, the transmission switch may be connected in parallel to the secondary side of the ADC to be closed in response to the switching control signal.

Preferably, but not necessarily, the defect information receiver may include a current measurer configured to measure a current at a primary side of the ADC, a voltage measurer configured to measure a voltage at a primary side of the ADC, and a defect determinator configured to calculate an electric energy or resistance value using the current measured by the current measurer and the voltage measured by the voltage measurer to discriminate whether the LED lamp has developed a defect, and to generate status information of the LED unit.

Preferably, but not necessarily, the status information of the LED unit may include at least any one of power information of the LED lamp and defect information of the LED lamp.

Preferably, but not necessarily, the individual lighting apparatus may further include a switching unit configured to maintain an input terminal at the primary side of the ADC at a closed circuit, and a powerless lamp opening detector configured to detect whether the LED lamp is electrically opened.

Preferably, but not necessarily, the powerless lamp opening detector may be configured to transmit to the switching unit an opening detection signal notifying that the LED lamp is electrically opened.

The airfield lighting system according to the exemplary embodiments of the present disclosure has an advantageous effect in that an operational defect of the airfield lighting system can be promptly checked and an adequate action thereto can be taken by allowing an individual lighting unit and a high-level monitoring panel to efficiently recognize or detect a defect of an LED lamp, in a case a lamp driven by a DC power source such as the LED lamp is applied to the airfield lighting system.

DETAILED DESCRIPTION OF THE INVENTION

Figure 1:
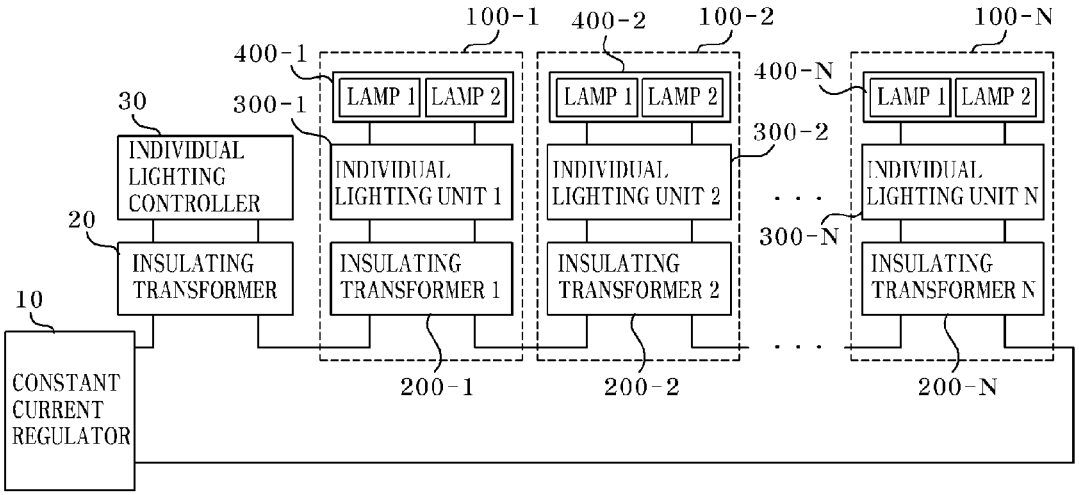
FIG. 1 is a schematic block diagram illustrating an ILCMS (Individual Lamp Control and Monitoring System) of an airfield lighting system according to the present disclosure.

In describing the present disclosure, detailed descriptions of constructions or processes known in the art may be omitted to avoid obscuring appreciation of the invention by a person of ordinary skill in the art with unnecessary detail regarding such known constructions and functions. Accordingly, the meaning of specific terms or words used in the specification and claims should not be limited to the literal or commonly employed sense, but should be construed or may be different in accordance with the intention of a user or an operator and customary usages. Therefore, the definition of the specific terms or words should be based on the contents across the specification. As used herein, the singular forms "a," "an" and "the" are intended to include the plural forms as well, unless the context clearly indicates otherwise. Like reference numerals refer to like elements throughout.

Now, the airfield lighting system according to exemplary embodiments of the present disclosure will be described in detail with reference to the accompanying drawings.

FIG. 1 is a schematic block diagram illustrating an individual lamp control and monitoring system of an airfield lighting system according to the present disclosure.

The system illustrated in FIG. 1 is a system generally buried under a runway of an airport, and is schematically illustrated to the maximum for the benefit of illustration, explanation and easy understanding. The system may further include much more number of elements for actual embodiment of the system.

Referring to FIG. 1, the individual lamp control and monitoring system of an airfield lighting system according to the present disclosure may include a CCR (Constant Current Regulator 10) configured to supply a constant current, an individual lighting controller 30 and individual lighting apparatus (100-1, 100-2, . . . **100-*n*). The individual lighting controller 30 serves to control the individual lighting apparatus (100-1, 100-2, . . . 100-*n*) forming a closed loop with the individual lighting unit 30, and may receive a necessary voltage from the CCR 10**.

The individual lighting apparatus (100-1, 100-2 . . . **100-*n*) are apparatus configured to light at least one lamp, receive voltage necessary for driving from insulating transformers (200-1. 200-2, . . . 200-*n*), where one or n number of individual lighting units (300-1, 300-2, . . . 300-*n*) may turn on or off at least one lamp to realize an operation necessary for aviation control. The individual lighting controller 30 and each of the individual lighting units (300-1, 300-2, . . . 300-*n***) may be embedded with a power line communication modem, and mutually transmit and receive a control command using the power line communication.

For example, the individual lighting controller 30 turns on and off the CCR 10 in response to a control command transmitted from a control tower, and communicates with the individual lighting units (300-1, 300-2, . . . **300-*n*) using the power line communication. Each of the individual lighting units (300-1, 300-2 . . . 300-*n*) turns on or off the lamps mounted on lamp units (400-1, 400-2, . . . 400-*n*) in response to the control command transmitted from the individual lighting controller 30, and transmits status information of the lamps to the individual lighting controller 30. The lamps are turned on or off, or adjusted in brightness in response to the control commands from the CCR 10 and the individual lighting controller 30**.

Meanwhile, in a case the lamp units (400-1, 400-2, . . . **400-*n*) include a lamp indicating the defect status of the lamps as 'short-circuit' along with a halogen lamp, one or n number of individual lighting units (300-1, 300-2, . . . 300-*n*) may detect the short-circuit of the lamp and transmit the defect status to the individual lighting controller 30**.

However, in a case an LED lamp is included, except for non-installation of the LED lamp, a closed circuit is formed by a primary side (i.e., primary side of a transformer) of an ADC configured to supply an electric power to the LED lamp regardless of whether there is a defect on the LED lamp, whereby one or n number of individual lighting units (300-1, 300-2, . . . **300-*n***) may not detect occurrence of defect on the LED lamp.

Hereinafter, description will be made to an airfield lighting system configured to recognize, by the individual lighting units (300-1, 300-2, . . . **300-*n*), whether LED lamps are defective, including a configuration of detecting, transmitting status changes of the LED lamps to the individual lighting units (300-1, 300-2, . . . 300-*n*) and the lamp units (400-1, 400-2, . . . 400-*n***) and receiving the status changes of the LED lamps, in a case the LED lamps develop defects.

Figure 2:
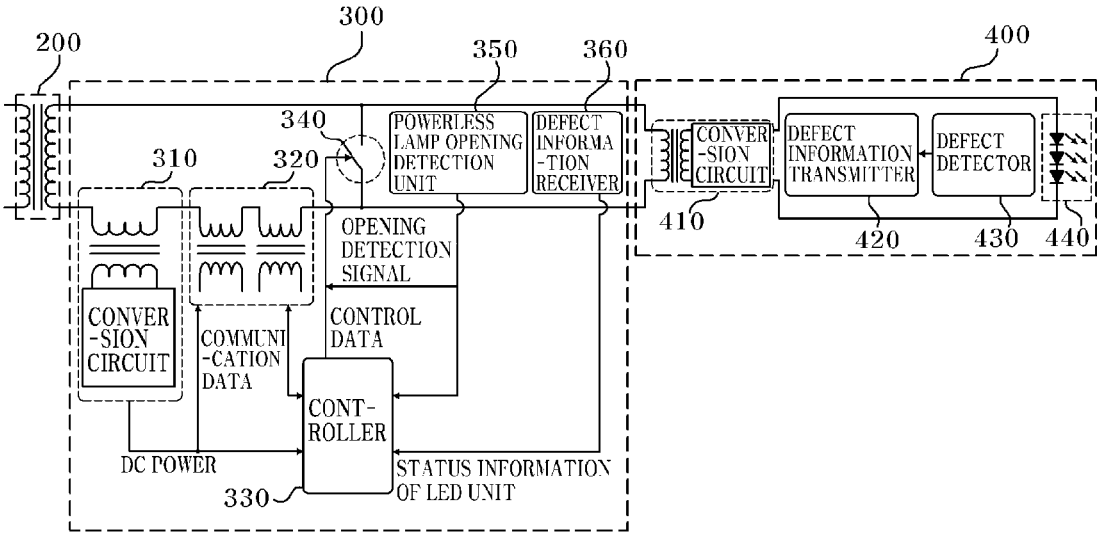
FIG. 2 is a schematic block diagram illustrating a configuration of an airfield lighting system according to an exemplary embodiment of the present disclosure.

FIG. 2 is a schematic block diagram illustrating a configuration of an airfield lighting system according to an exemplary embodiment of the present disclosure.

Referring to FIG. 2, an insulating transformer 200, an individual lighting unit 300 and an LED lamp unit 400 may form each of the individual lighting apparatus (100-1, 100-2, . . . 100-*n*).

The insulating transformer 200 converts a maximum rating supplied from the CCR 10 illustrated in FIG. 1, e.g., a constant current of 6.6 A, to an AC signal, and transmits the current to the individual lighting unit 300 connected to a secondary side coil of the insulating transformer 200.

The AC signal converted by the insulating transformer 200 flows along a closed circuit of the individual lighting unit 300. The AC signal may pass a primary side coil of a second ADC 410, pass a power cable communication unit 320 and a primary side coil of a first ADC 310, and feedback to a secondary side coil of the insulating transformer 200. The individual lighting unit 300 includes a first ADC 310, a power cable communication unit 320, a controller 330, a switching unit 340, a powerless lamp opening detection unit 350 and a defect information receiver 360.

The AC signal returned to the secondary side coil of the insulating transformer 200 may be applied to the primary side coil of a first ADC 310. The first ADC 310 may convert the AC signal to a DC signal for supplying a driving electric power to the power cable communication unit 320 and the controller 330. The ADC 310 may include a conversion circuit, where the conversion circuit may include a rectifier and a regulator for supplying an electric power of adequate level to the power cable communication unit 320 and the controller 330.

The power cable communication unit 320 can provide a communication with the individual lighting apparatus and an upper level monitoring panel (e.g., the individual lighting controller 30 of FIG. 1). Meanwhile, the power cable communication unit 320 may perform a same function through a separate communication unit, and may provide a wired or a wireless communication.

The controller 330 receives the status information of the LED lamp unit 400 from the defect information receiver 360. The status information of the LED lamp unit 400 may include shirt-circuit of a primary side or secondary side of a second ADC 410, defect information of a conversion circuit mounted on the second ADC 410, defect information of an LED lamp 440 and electric energy information of the LED lamp 440.

Furthermore, the controller 330 may transmit the status information of the LED lamp 440 to the high-level monitoring panel through the power cable communication unit 320, receive an ON/OFF control signal of the LED lamp 440 from the high-level monitoring panel and control the ON/OFF of the LED lamp 440. As noted above, the controller 330 can receive the status information of the LED lamp unit 400 from the defect information receiver 360 without recourse to a separate communication module.

The switching unit 340 and the powerless lamp opening detection unit 350 are a configuration for maintaining a closed circuit of the individual lighting unit 300. That is, in a case the LED lamp 440 develops an abnormality (caused by defect or accident) to open the closed circuit of the individual lighting unit 300, electric power supply to the individual lighting unit 300 is lost to disable any function, where opening of some constituent elements in the closed circuit causes operation disablement of all constituent elements in the closed circuit, as previously described with reference to FIG. 1.

The powerless lamp opening detection unit 350 may be formed to detect opening of the LED lamp 440. If it is determined or detected that the LED lamp 440 is electrically opened (e.g., the LED lamp is not installed), the powerless lamp opening detection unit 350 transmits an opening detection signal to the switching unit 340 and the controller 330. The switching unit 340 having received the opening detection signal forms a closed circuit formed by the insulating transformer 200, the power cable communication unit 320 and the first ADC 310, by closing a switch.

Even in this case, the switching unit 340 may perform the function of maintaining an AC signal input terminal of the primary side coil of the second ADC 410 as a closed circuit. That is, the switching unit 340 may close the switch by being arranged on an AC signal path to allow the insulating transformer 200, the power cable communication unit 320 and the first ADC 310 to form a closed circuit between the insulating transformer 200 and the second ADC 410, even if the LED lamp 440 is electrically opened.

Furthermore, the switching unit 340 may be used as something for turning on/off the LED lamp 440. The controller 330 or the high-level monitoring panel may control the switching unit 340 for turning off the LED lamp 440.

The defect information receiver 360 measures a current of the second ADC 410, calculates the consumed electric energy of the LED lamp unit 400, to be more specific, the consumed electric energy and the resistance value of the LED lamp unit 400, using the measured current and voltage, generates status information of the LED lamp unit 400, and provides the generated status information to the controller 330. As mentioned above, the status information of the LED lamp unit 400 may include short-circuit at the primary side or the secondary side of the second ADC 410, defect information of the conversion circuit mounted on the second ADC 410, the electric energy of the LED lamp 440, and the defect information of the LED lamp 440.

For example, the defect information receiver 360 may determine short-circuit of the primary side or the secondary side of the second ADC 410 based on the calculated electric energy. If short-circuit develops at the primary side of the second ADC 410, the electric energy may reach almost zero value. Furthermore, short-circuit develops at the secondary side of the second ADC 410, the electric energy may have a value much less than that of normal operation (a state of all the LED lamps being turned on). Based on this method, the defect information receiver 360 may determine short-circuit at the primary side or the secondary side of the second ADC 410. Furthermore, the defect information receiver 360 may determine operational status of the LED lamp 400 based on the calculated electric energy.

Meanwhile, as opposed to what is described in FIG. 2, assuming that three (3) LED lamps 440 are arranged in parallel, an electric energy when all three parallel-connected LED lamps are normally operated may differ from an electric energy when one of the three parallel-connected LED lamps is defective. Thus, the defect information receiver 360 may determine occurrence of defects on the LED lamps 440 using the difference in electric energy. Detailed description on the defect information receiver 360 will be additionally explained later with reference to FIG. 5.

The LED lamp unit 400 includes a second ADC 410, a defect information transmitter 420, a defect detector 430 and an LED lamp 440. Although FIG. 2 has illustrated the LED lamp unit 400 that is included with the LED lamp 440, the LED lamp 440 may be realized as an individual device separate from the LED lamp unit 400. Furthermore, although reference numeral 440 is defined as the LED lamp, any lamp driven by a DC electric power may be applied.

The AC signal converted by the insulating transformer 200 is applied to the primary side coil of the second ADC 410, where the second ADC 410 converts the AC signal to a DC signal and provides the converted DC signal to a driving electric power of the LED lamp 440.

Like the first ADC 310, the second ADC 410 may include a conversion circuit, where the conversion circuit may include a rectifier and a regulator for supplying an electric power of an adequate level. The defect information transmitter 420 and the defect detector 430 serve to detect the defects of the LED lamps 440 and provide the detected defects to the defect information receiver of the individual lighting unit 300.

The defect detector 430 determines the defects by detecting status changes of the LED lamp unit 400 including the LED lamp 440, and the conversion circuit of the second ADC 410. If it is determined that the status change of the LED lamp unit 400 is 'defective', the defect detector 430 outputs a defect detection signal to the defect information transmitter 420. For example, in a case the status change is determined as being 'defective', it means that defects on the conversion circuit of the second ADC 410 and the LED lamp 440 have occurred.

In a case the defect detection signal is inputted from the defect detector 430, the defect information transmitter 420 opens or closes a secondary side path of the second ADC 410, and transmits defect information of the LED lamp 440 to the defect information receiver 360. That is, the defect information transmitter 420 can change the electric energy calculated by the defect information receiver 360 by opening or closing the secondary side path of the second ADC 410 in response to status changes of the LED lamp unit 400, and allow the individual lighting unit 300 to recognize the status information of the LED lamp unit 400.

The detailed description of the defect information transmitter 420 will be additionally explained later with reference to FIGS. 3 and 4.

Meanwhile, although not described in FIG. 2, the LED lamp unit 400 may include an LED current controller. The LED current controller may estimate a current of the CCR 10 illustrated in FIG. 1 and adjust a current supplied to the LED lamp 440 by using a DC power from the second ADC 410 in response to brightness of the LED lamp 330 corresponding to the current estimated by the CCR 10.

Figure 3:
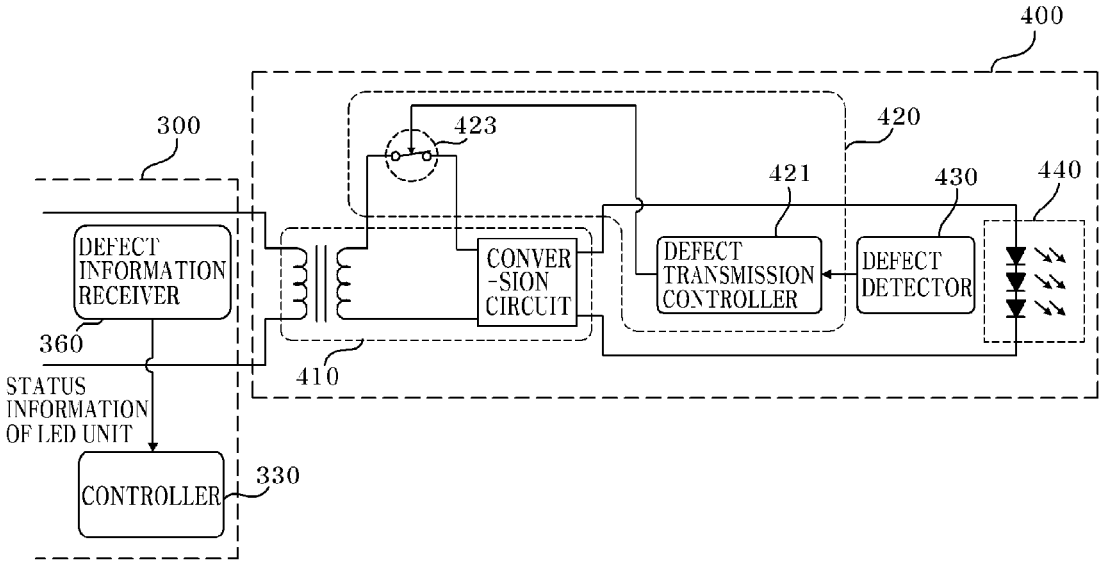
FIG. 3 is a schematic block diagram illustrating a defect information transmitter of FIG. 2 according to a first applicable example of the present disclosure.

FIG. 3 is a schematic block diagram illustrating a defect information transmitter of FIG. 2 according to a first applicable example of the present disclosure.

Referring to FIG. 3, the defect information transmitter 420 includes a defect transmission controller 421 and a transmission switch 423.

The defect transmission controller 421 generates a switching control signal for opening the transmission switch 423 in a case a defect detection signal is received from the defect detector 430.

The transmission switch 423 is connected in series between a secondary side of a transformer mounted on the second ADC 410 and a conversion circuit, and as a result, the transmission switch 423 is preferably operated in a normally closed method. That is, the transmission switch 423 is in a state of being closed during normal times (i.e., continuously from an initial state), and is in a state of being opened in a case a switching signal is supplied to the defect transmission controller 421.

Hereinafter, an operation of the defect information transmitter 420 in response to the status changes in the LED lamp unit 400 will be described in detail.

Prior to receipt of the defect detection signal from the defect detector 430, the defect transmission controller 421 does not output the switching control signal and the transmission switch 423 keeps a closed state, such that a DC power is supplied to other configurations of the LED lamp unit 400 including a conversion circuit mounted on the second ADC 410.

In a case the defect detector 430 detects status changes of the LED lamp unit 400, i.e., detects that defect has occurred, the defect detector 430 transmits the detected defect detection signal to the defect transmission controller 421. The defect transmission controller 421 generates the switching control signal in response to the supplied defect detection signal, and provides the defect detection signal to the transmission switch 423.

The transmission switch 423 is opened in response to the switching control signal provided from the defect transmission controller 421. The transmission switch 423 is connected in series between a secondary side of a transformer mounted on the second ADC 410 and a conversion circuit, and as a result, an output terminal path of the second ADC 410 is short-circuited in response to opening of the transmission switch 423, whereby no power is supplied to the conversion circuit and the LED lamp 440. As a result, a considerably low voltage is applied to the secondary side of the second ADC 410 to reduce the power consumption to a considerably level.

The defect information receiver 360 (i.e., the primary side of the second ADC 410) can detect the status change i.e., the defect of the LED unit 400, in response to great changes in measured voltage and current, calculated resistance value and power consumption, and generate the status change of the LED unit 400 based thereon and transmit the status change to the controller 330. That is, the present disclosure can allow the individual lighting unit 300 to recognize the status change of the LED unit 400 as one type of events whereby the individual lighting unit 300 and the upper-level monitoring panel can receive the status information of the LED unit 400 without recourse to separate installation of a communication module.

Meanwhile, the defect transmission controller 421 is not supplied with a power in response to opening of the transmission switch 423, whereby a predetermined time difference is generated between a time when the transmission switch 423 is opened by capacitor elements inside the circuit and a time when the defect transmission controller 421 is turned off.

In a case the capacitor elements are completely discharged, the defect transmission controller 421 is turned off to prevent the switching control signal from being outputted, whereby the transmission switch 423 of normal connection method is closed again, and each element included in the LED unit 400 is applied with a DC power. The predetermined time difference may be changed by adjusting a charging capacity of the capacitor elements and therefore the defect information receiver 360 preferably measures the voltage and current and determines the charge capacity of the capacitor elements in consideration of time consumed in calculating the power consumption.

Figure 4:
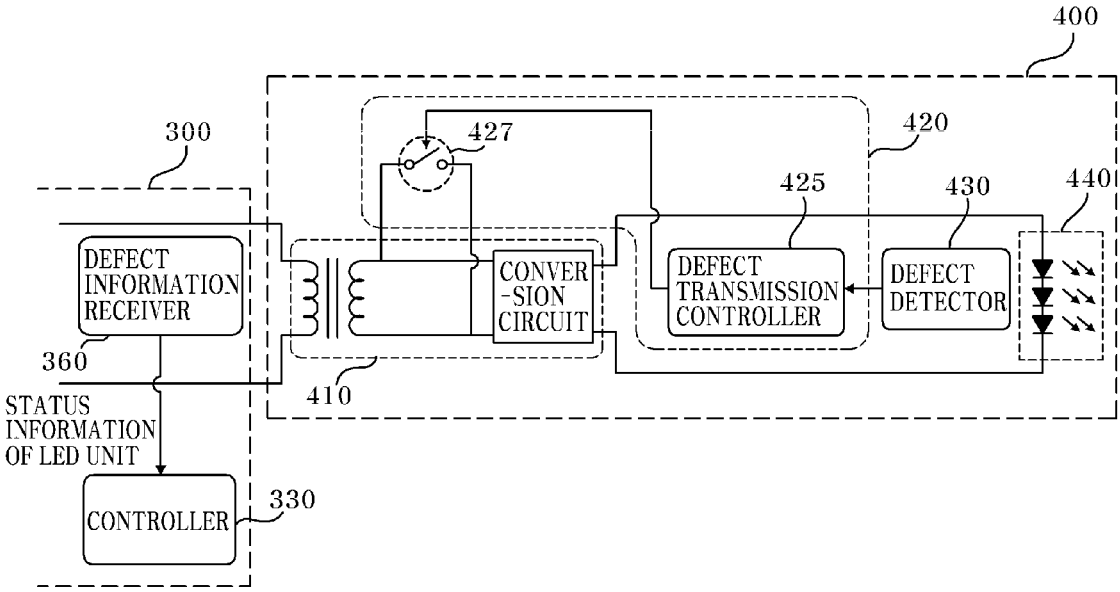
FIG. 4 is a schematic block diagram illustrating a defect information transmitter of FIG. 2 according to a second applicable example of the present disclosure.

FIG. 4 is a schematic block diagram illustrating a defect information transmitter of FIG. 2 according to a second applicable example of the present disclosure.

Referring to FIG. 4, the defect information transmitter 420 includes a defect transmission controller 425 and a transmission switch 427.

The defect transmission controller 425 functions to generate a switching control signal, opening the transmission switch 427, in a case a defect detection signal is received from the defect detector 430, and performs a function similar to that of the defect transmission controller 421 of FIG. 3.

The transmission switch 427 is connected in parallel between a secondary side of a transformer mounted on the second ADC 410 and a conversion circuit, and as a result, the transmission switch 427 is preferably operated in a normally opened method. That is, the transmission switch 427 is in a state of being opened during normal times (i.e., continuously from an initial state) and is in a state of being closed in a case a switching control signal is supplied from the defect transmission controller 425.

Hereinafter, an operation of the defect information transmitter 420 will be described in detail in response to status changes of the LED lamp unit 400.

Prior to receipt of the defect detection signal from the defect detector 430, the defect transmission controller 425 does not output the switching control signal and the transmission switch 427 keeps an opened state, such that a DC power is supplied to other configurations of the LED lamp unit 400 including a conversion circuit mounted on the second ADC 410.

In a case the defect detector 430 detects status changes of the LED lamp unit 400, i.e., detects that defect has occurred, the defect detector 430 transmits the detected defect detection signal to the defect transmission controller 425. The defect transmission controller 425 generates the switching control signal in response to the defect detection signal supplied from the defect detector 430, and provides the defect detection signal to the transmission switch 427 to be closed.

Furthermore, the transmission switch 427 is connected in parallel between a secondary side of a transformer mounted on the second ADC 410 and a conversion circuit, and as a result, the transmission switch 427 is closed, whereby no power is supplied to the conversion circuit and the LED lamp 440. Hence, a considerably low voltage is applied to the secondary side of the second ADC 410 to increase power consumption to a considerably level over a normal state.

The defect information receiver 360 (i.e., the primary side of the second ADC 410) can detect the status change i.e., the defect of the LED unit 400, in response to great changes in measured voltage and current, calculated resistance value and power consumption over the normal state, and generate the status information of the LED unit 400 based thereon and transmit the status change to the controller 330. That is, the present disclosure can allow the individual lighting unit 300 to recognize the status change of the LED unit 400 as one type of events whereby the individual lighting unit 300 and the upper-level monitoring panel can receive the status information of the LED unit 400 without recourse to separate installation of a communication module.

Meanwhile, the defect transmission controller 425 is not supplied with a power either in response to closing of the transmission switch 427, whereby a predetermined time difference is generated between a time when the transmission switch 427 is closed by capacitor elements inside the circuit and a time when the defect transmission controller 425 is turned off.

In a case the capacitor elements are completely discharged, the defect transmission controller 425 is turned off to prevent the switching control signal from being outputted, whereby the transmission switch 427 is opened again, and each element included in the LED unit 400 is applied with a DC power. The predetermined time difference may be changed by adjusting a charging capacity of the capacitor elements and therefore the defect information receiver 360 preferably measures the voltage and current and determines the charge capacity of the capacitor elements in consideration of time consumed in calculating the power consumption.

Figure 5:
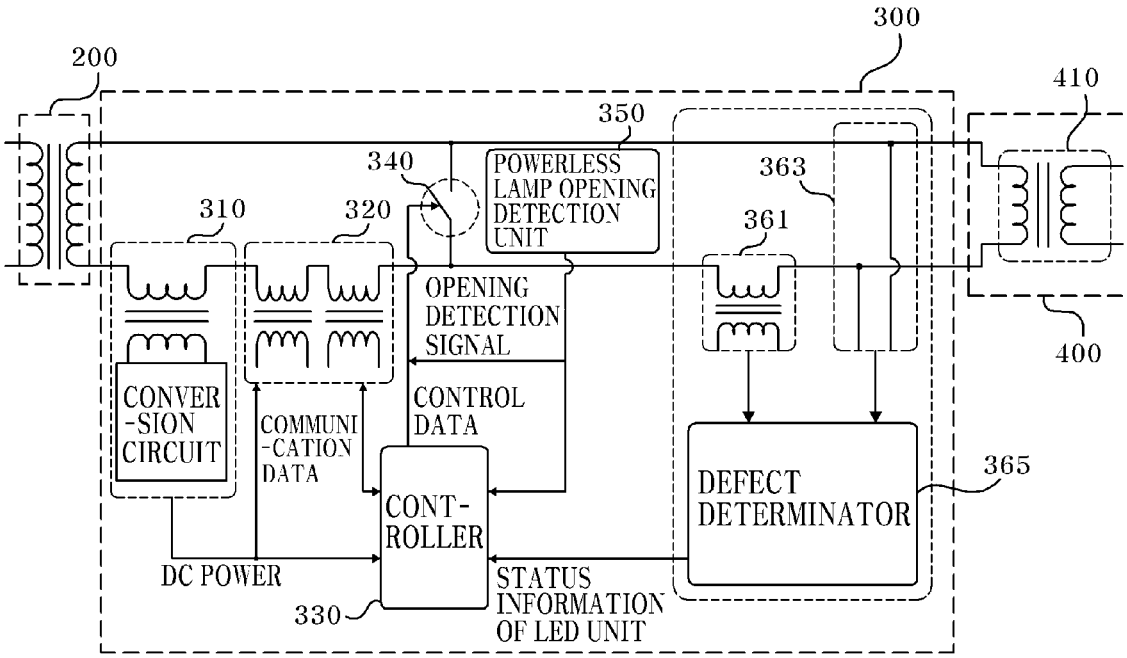
FIG. 5 is an exploded perspective view illustrating a detailed configuration of a defect information receiver of FIG. 2 according to the present disclosure.

FIG. 5 is an exploded perspective view illustrating a detailed configuration of a defect information receiver of FIG. 2 according to the present disclosure.

Referring to FIG. 5, the defect information receiver 360 includes a current measurer 361, a voltage measurer 363 and a defect determinator 365.

The current measurer 361 is a current measurement interface so configured as to measure a current flowing on a primary side path of the second ADC 410. A current transformer is generally used for the current measurement interface, and the current measurement interface changes a current flowing on the path to a voltage value and provides the voltage value to the defect determinator 365.

The voltage measurer 363 is a voltage measurement interface so configured as to measure a voltage at both ends of a primary side path of the second ADC 410, and transmits the measured voltage value to the defect determinator 365.

The defect determinator 365 calculates a resistance and electric energy by using a current value and a voltage value transmitted from the current measurer 361 and the voltage measurer 363.

Furthermore, the defect determinator 365 generates status information of the LED lamp unit 400 by comparing the measured current and voltage, calculated resistance and the electric energy with a current, a voltage and an electric energy under a normal state. That is, in a case a defect is developed on the LED lamp unit 400 to make the calculated electric energy much smaller or much greater than that of a normal state, or to make the calculated resistance value much greater or much smaller than that of normal state, the defect determinator 365 recognizes that defect has developed on the LED lamp unit 400 (e.g., defect of the LED lamp, defect of the conversion circuit, etc.), and generates status information of the LED lamp unit 400 based thereon.

Meanwhile, although the defect determinator 365 is described to detect the status changes of the LED lamp unit 400 using the measured current, voltage and calculated resistance and electric energy, and to generate the status information of the LED lamp unit 400 for transmission to the controller 330, the defect determinator 365 may function to calculate resistance and electric energy using the measured current and voltage, and the controller 330 may generate the status information of the LED lamp unit 400 by receiving the measured current and voltage and the calculated resistance and electric energy to determine the status changes of the LED lamp unit 400.

Although exemplary embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims.

What is claimed is:

1. An airfield lighting system including a constant current regulator configured to output a constant current, a plurality of insulating transformers configured to be electrically connected to the constant current regulator to supply an electric power, and a plurality of individual lighting devices each electrically connected to the insulating transformer to turn on or turn off an LED lamp, wherein the individual lighting apparatus includes an LED unit including an ADC (AC-DC Converter) and at least one LED lamp connected to a secondary side of the ADC and transmitting defect information of the LED lamp, and a defect information receiver configured to measure a current and a voltage at a primary side of the ADC, measure an electric energy (electricity) or a resistance value using the measured current and voltage, and generate status information of the LED unit.

2. The airfield lighting system of claim 1, wherein the LED unit includes a defect detecting unit configured to output a defect detection signal, in a case defect of the LED lamp is detected, and a defect information transmitter configured to transmit the defect information of the LED lamp by opening or closing a path at the secondary side of the ADC to the defect information receiver, in a case the defect detection signal is received from the defect detection unit.

3. The airfield lighting system of claim 2, wherein the defect information transmitter includes a defect transmission controller configured to output a switching control signal, in a case the defect detection signal is received from the defect detection unit, and a transmission switch configured to be opened or closed in response to the switching control signal outputted from the defect transmission controller.

4. The airfield lighting system of claim 3, wherein the transmission switch is connected in series to the secondary side of the ADC to be opened in response to the switching control signal.

5. The airfield lighting system of claim 3, wherein the transmission switch is connected in parallel to the secondary side of the ADC to be closed in response to the switching control signal.

6. The airfield lighting system of claim 1, wherein the defect information receiver includes a current measurer configured to measure a current at a primary side of the ADC, a voltage measurer configured to measure a voltage at a primary side of the ADC, and a defect determinator configured to calculate an electric energy or resistance value using the current measured by the current measurer and the voltage measured by the voltage measurer to discriminate whether the LED lamp has developed a defect, and to generate status information of the LED unit.

7. The airfield lighting system of claim 1, wherein the status information of the LED unit includes at least any one of power information of the LED lamp and defect information of the LED lamp.

8. The airfield lighting system of claim 1, wherein the individual lighting apparatus further includes a switching unit configured to maintain an input terminal at the primary side of the ADC at a closed circuit, and a powerless lamp opening detector configured to detect whether the LED lamp is electrically opened.

9. The airfield lighting system of claim 8, wherein the powerless lamp opening detector is configured to transmit to the switching unit an opening detection signal notifying that the LED lamp is electrically opened.

* * * * *